US009512701B2

(12) United States Patent
Duphorne et al.

(10) Patent No.: US 9,512,701 B2
(45) Date of Patent: Dec. 6, 2016

(54) FLOW CONTROL DEVICES INCLUDING A SAND SCREEN AND AN INFLOW CONTROL DEVICE FOR USE IN WELLBORES

(71) Applicants: Darin H. Duphorne, Houston, TX (US); Colin P. Andrew, Cypress, TX (US)

(72) Inventors: Darin H. Duphorne, Houston, TX (US); Colin P. Andrew, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 531 days.

(21) Appl. No.: 13/940,906

(22) Filed: Jul. 12, 2013

(65) Prior Publication Data

US 2015/0013980 A1 Jan. 15, 2015

(51) Int. Cl.
*E21B 43/12* (2006.01)
*E21B 43/08* (2006.01)

(52) U.S. Cl.
CPC ..... *E21B 43/12* (2013.01); *E21B 43/088* (2013.01)

(58) Field of Classification Search
CPC ..... E21B 43/088; E21B 43/12
See application file for complete search history.

(56) References Cited

U.S. PATENT DOCUMENTS 80,875 A 8/1868 Platt et al.
85,428 A 12/1868 Burditt et al.
1,339,898 A * 5/1920 Layne ..... E21B 43/088 166/232
1,342,813 A 6/1920 Huston
1,635,368 A * 7/1927 Layne ..... E21B 43/088 166/231
2,046,459 A * 7/1936 Johnson ..... B01D 29/15 166/233
2,185,999 A * 1/1940 Johnson ..... E21B 43/088 228/182
3,025,914 A 3/1962 Fether
3,133,595 A 5/1964 Loughney et al.
4,096,911 A * 6/1978 Geske ..... B01D 24/24 166/234
4,125,129 A 11/1978 Baumann
4,176,717 A 12/1979 Hix
4,267,045 A 5/1981 Hoof
(Continued)

FOREIGN PATENT DOCUMENTS

WO 0026501 A1 5/2000
WO WO2007078375 A2 7/2007
(Continued)

OTHER PUBLICATIONS

PCT International Search Report and Written Opinion; International Application No. PCT/US2015/017515; International Filing Date: Feb. 25, 2015; Date of Mailing: Jun. 8, 2015; 16 Pages.
(Continued)

*Primary Examiner* — Jennifer H Gay
(74) *Attorney, Agent, or Firm* — Cantor Colburn LLP

(57) ABSTRACT

A flow control device is disclosed. The device includes a tubular member having a plurality adjacent wraps, wherein each wrap has an outer surface and an inner surface. Some of the wraps include one or more flow control paths, wherein each such flow control path includes a tortuous path to control flow of a fluid from the outer surface to the inner surface.

29 Claims, 8 Drawing Sheets

(56) References Cited

U.S. PATENT DOCUMENTS

| | | | | |
|---|---|---|---|---|
| 5,122,271 | A | 6/1992 | Simon et al. | |
| 5,341,880 | A | 8/1994 | Thorstensen | |
| 5,769,122 | A | 6/1998 | Baumann et al. | |
| 6,125,932 | A * | 10/2000 | Hamid | E21B 43/088 166/233 |
| 6,978,840 | B2 | 12/2005 | Henderson | |
| 7,055,598 | B2 | 6/2006 | Ross et al. | |
| 7,284,606 | B2 | 10/2007 | Coronado | |
| 7,578,343 | B2 | 8/2009 | Augustine | |
| 7,673,678 | B2 | 3/2010 | MacDougall et al. | |
| 7,891,420 | B2 * | 2/2011 | Dale | E21B 43/088 166/231 |
| 8,201,623 | B2 | 6/2012 | O'Brien | |
| 8,220,555 | B1 | 7/2012 | Wintill et al. | |
| 8,403,061 | B2 | 3/2013 | Russell et al. | |
| 8,403,064 | B2 | 3/2013 | Allen | |
| 8,424,609 | B2 | 4/2013 | Duphorne et al. | |
| 2002/0092653 | A1 | 7/2002 | Scott et al. | |
| 2003/0141059 | A1 | 7/2003 | Mauldin et al. | |
| 2003/0188894 | A1 | 10/2003 | Sunde et al. | |
| 2005/0039916 | A1 | 2/2005 | Schultz et al. | |
| 2006/0027377 | A1 | 2/2006 | Schoonderbeek et al. | |
| 2007/0131434 | A1 | 6/2007 | MacDougall et al. | |
| 2009/0133874 | A1 | 5/2009 | Dale et al. | |
| 2010/0163250 | A1 | 7/2010 | Schultz et al. | |
| 2010/0252250 | A1 | 10/2010 | Fripp et al. | |
| 2011/0048706 | A1 | 3/2011 | Clem et al. | |
| 2011/0079396 | A1 | 4/2011 | Russell et al. | |
| 2011/0127047 | A1 | 6/2011 | Themig et al. | |
| 2011/0146988 | A1 | 6/2011 | Mcglothen | |
| 2011/0186286 | A1 | 8/2011 | Allen | |
| 2011/0209873 | A1 | 9/2011 | Stout | |
| 2011/0226481 | A1 | 9/2011 | Duphorne et al. | |
| 2011/0278017 | A1 | 11/2011 | Themig et al. | |
| 2012/0085548 | A1 | 4/2012 | Fleckenstein et al. | |
| 2013/0108356 | A1 | 5/2013 | Stautzenberger et al. | |
| 2015/0013966 | A1 * | 1/2015 | O'Brien | E21B 43/088 166/228 |
| 2015/0013980 | A1 * | 1/2015 | Duphorne | E21B 43/088 166/276 |
| 2015/0375144 | A1 * | 12/2015 | Greci | E21B 43/08 29/896.61 |

FOREIGN PATENT DOCUMENTS

| | | |
|---|---|---|
| WO | 2012162792 | 12/2012 |
| WO | WO2012162792 A1 | 12/2012 |

OTHER PUBLICATIONS

PCT International Search Report and Written Opinion, International Application No. PCT/US2014/042081; International Filing Date: Jun. 12, 2014; Date of Mailing: Oct. 6, 2014; pp. 1-14.

PCT International Search Report and Written Opinion; International Application No. PCT/US2014/055889; International Filing Date: Sep. 16, 2014; Date of Mailing: Dec. 23, 2014; pp. 1-10.

PCT International Search Report and Written Opinion; International Application no. PCT/US2014/055886; International Filing Date: Sep. 16, 2014; Date of Mailing: Dec. 19, 2014; pp. 1-9.

PCT International Search Report and Written Opinion; International Application no. PCT/US2014/055887; International Filing Date: Sep. 16, 2014; Date of Mailing: Dec. 18, 2014; pp. 1-10.

PCT International Search Report and Written Opinion; International Application No. PCT/US2015/014607; International Filing Date: Feb. 5, 2015; Date of Mailing: May 19, 2015; pp. 1-10.

* cited by examiner

FLOW CONTROL DEVICES INCLUDING A SAND SCREEN AND AN INFLOW CONTROL DEVICE FOR USE IN WELLBORES

BACKGROUND

1. Field of the Disclosure

The disclosure relates generally to apparatus and methods for control of fluid flow from subterranean formations into a production string in a wellbore.

2. Description of the Related Art

Hydrocarbons such as oil and gas are recovered from subterranean formations using a well or wellbore drilled into such formations. In some cases the wellbore is completed by placing a casing along the wellbore length and perforating the casing adjacent each production zone (hydrocarbon bearing zone) to extract fluids (such as oil and gas) from such a production zone. In other cases, the wellbore may be open hole, and in a particular case may be used for injection of steam or other substances into a geological formation. One or more, typically discrete, flow control devices are placed in the wellbore within each production zone to control the flow of fluids from the formation into the wellbore. These flow control devices and production zones may be active or passive and are generally fluidly isolated or separated from each other by packers. Fluid from each production zone entering the wellbore typically travels along an annular area between a production tubular that runs to the surface and either a casing or the open hole formation and is then drawn into the production tubular through the flow control device. The fluid from a reservoir within a formation ("reservoir fluid") often includes solid particles, generally referred to as the "sand", which are more prevalent in unconsolidated formations. In such formations, flow control devices generally include a sand screen system that inhibits flow of the solids above a certain size into the production tubular.

It is often desirable also to have a substantially even flow of the formation fluid along a production zone or among production zones within a wellbore. In either case, uneven fluid flow may result in undesirable conditions such as invasion of a gas cone or water cone. Water or gas flow into the wellbore in even a single production zone along the wellbore can significantly reduce the amount and quality of the production of oil along the entire wellbore. Flow control devices may be actively-controlled flow control valves, such as sliding sleeves, which are operated from the surface or through autonomous active control. Other flow control devices may be passive inflow control devices designed to preferentially permit production or flow of a desired fluid into the wellbore, while inhibiting the flow of water and/or gas or other undesired fluids from the production zones. Sand screens utilized in production zones typically lack a perforated base pipe and require the formation fluid to pass through the screen filtration layers before such fluid can travel along the annular pathway along approximately the entire length of the production zone before it enters the production tubular at a discrete location.

Horizontal wellbores are often drilled into a production zone to extract fluid therefrom. Several flow control devices are placed spaced apart along such a wellbore to drain formation fluid. Formation fluid often contains a layer of oil, a layer of water below the oil and a layer of gas above the oil. A horizontal wellbore is typically placed above the water layer. The boundary layers of oil, water and gas may not be even along the entire length of the horizontal wellbore. Also, certain properties of the formation, such as porosity and permeability, may not be the same along the horizontal wellbore length. Therefore, for these and other reasons, fluid between the formation and the wellbore may not flow evenly through the inflow control devices. For production wellbores, it is desirable to have a relatively even flow of the production fluid into the wellbore. To produce optimal flow of hydrocarbons from a wellbore, production zones may utilize flow control devices with differing flow characteristics.

A common type of sand screen is known as a "wire wrapped screen". Such sand screens generally are formed by placing standoffs axially on a tubular and then wrapping a wire around the standoffs. The closely controlled spacing between adjacent wire wraps defines the grain sizes inhibited from flowing through the sand screen. Conventional discrete flow control devices are expensive and can require substantial radial space, which can reduce the internal diameter of the production tubing available for the production or flow of the hydrocarbons to the surface. Also, the typical single entry point along a production zone is inefficient and if there is an encroachment of sand or other particles larger than the spacing between the wire wraps, the annular flow area within the sand screen system could become blocked, thereby limiting the production of formation fluid from the entire production zone.

The present disclosure provides flow control devices and methods of using the same that enable flow of formation fluids radially from a production zone into the production tubular and may optionally include an integrated sand screen.

SUMMARY

In one aspect, a flow control device is disclosed that in one embodiment may include a tubular member having a plurality of adjacent wraps, wherein each wrap has an outer surface and an inner surface and wherein some of the wraps include one or more flow control paths, wherein each such flow control path includes a tortuous path to control flow of a fluid from the outer surface to the inner surface.

In another aspect, a method of making a flow control device is disclosed that in one embodiment may include providing a longitudinal member having a plurality of channels extending from a first side to a second side, forming a fluid flow control path in at least some of the channels in the plurality of channels and forming a longitudinal tubular member using the longitudinal member to provide the flow control device. In another aspect, the method may include axially stacking a plurality of discs to form a longitudinal member, wherein at least some of discs include channels that further include one or more tortuous fluid flow paths.

Examples of some features of the disclosure have been summarized rather broadly in order that detailed description thereof that follows may be better understood, and in order that some of the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings, in which like reference characters generally designate like or similar elements throughout the several figures, and wherein.

DETAILED DESCRIPTION OF THE DISCLOSURE

Figure 1:
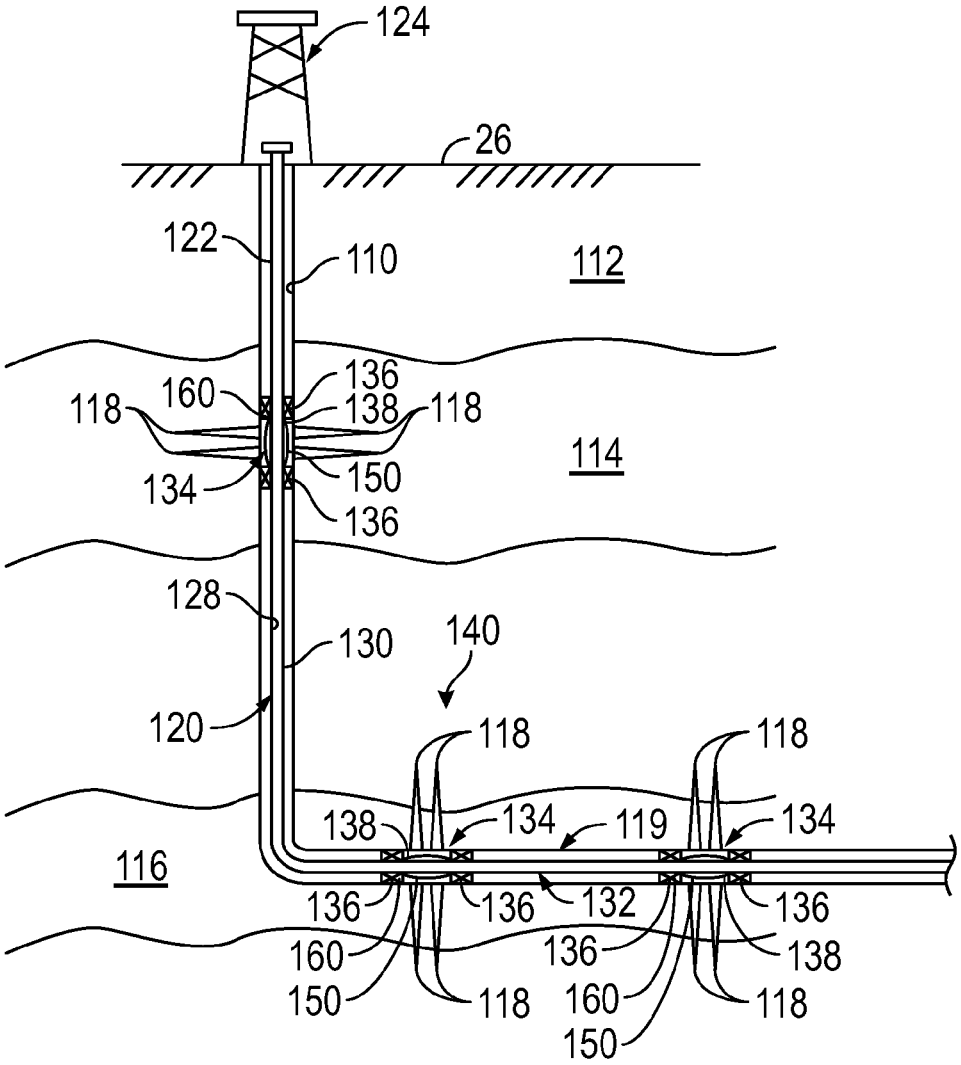
FIG. 1 is a schematic elevation view of an exemplary multi-zonal wellbore and production assembly which incorporates a sand screen according to one embodiment of the disclosure.

The present disclosure relates to devices and methods for controlling production of hydrocarbons in wellbores. The present disclosure is susceptible to embodiments of different forms. There are shown in the drawings, and herein will be described, specific embodiments of the present disclosure with the understanding that the present disclosure is to be considered an exemplification of the principles of the devices and methods described herein and is not intended to limit the disclosure to the specific embodiments. Also, the feature or a combination of features should not be construed as essential unless expressly stated as essential.

FIG. 1 shows an exemplary wellbore 110 that has been drilled through the earth formation 112 and into a pair of production formations or reservoirs 114, 116 from which it is desired to produce hydrocarbons. The wellbore 110 is cased by metal casing, as is known in the art, and a number of perforations 118 penetrate and extend into the formations 114, 116 so that production fluids 140 may flow from the formations 114, 116 into the wellbore 110. The wellbore 110 has a deviated or substantially horizontal leg 119. The wellbore 110 has a production string or assembly, generally indicated at 120, disposed therein by a tubing string 122 that extends downwardly from a wellhead 124 at the surface 126. The production assembly 120 defines an internal axial flow bore 128 along its length. An annulus 130 is defined between the production assembly 120 and the wellbore casing. The production assembly 120 has a deviated, generally horizontal portion 132 that extends along the deviated leg 119 of the wellbore 110. Production zones 134 are shown positioned at selected locations along the production assembly 120. Each production zone 134 may be isolated within the wellbore 110 by a pair of packer devices 136. Although only three production zones 134 are shown in FIG. 1, there may, in fact, be a large number of such zones arranged in serial fashion along the horizontal portion 132.

Each production zone may 134 may include a flow control or production flow control device 138 to govern one or more aspects of a flow of one or more fluids into the production assembly 120. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. In accordance with embodiments of the present disclosure, the production control device 138 may include a number of alternative constructions of sand screen 150 and an inflow control device 160 that inhibits the flow of solids from the formations 114 and 116 into the string 120.

Figure 2:
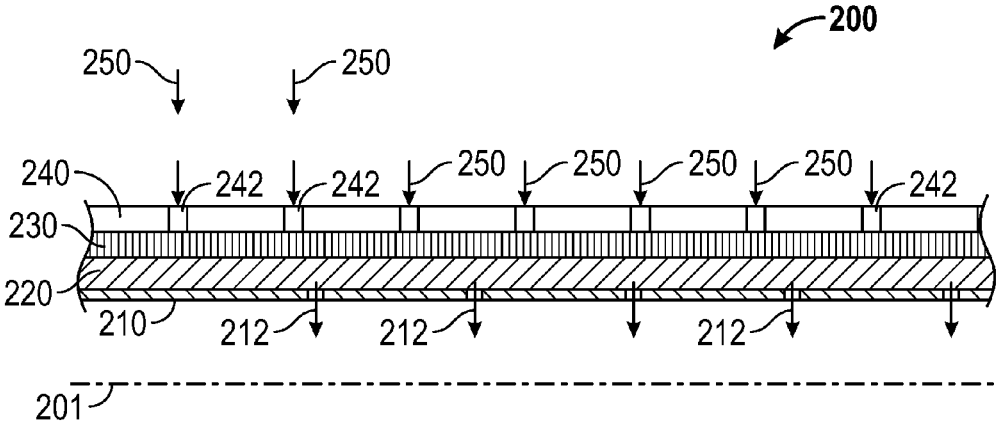
FIG. 2 shows a sectional side view of a portion of a flow control device made according to one embodiment the disclosure.

FIG. 2 shows a longitudinal sectional side-view of a flow control device 200 made according to one embodiment the disclosure. The flow control device includes a base pipe or tubular 210 having an axis 201 and a number of radially and axially placed fluid passages 212. The tubular 210 is surrounded by an inflow flow control device 220 that controls the flow of a fluid 250 into the passages 212. A sand screen 230, made according to one embodiment of the disclosure, is shown placed around the inflow control device 220 to inhibit flow of solid particles above a certain size through the sand screen 230. A shroud 240 having flow passages 242 may be placed around the sand screen 230 to protect the sand screen 230 and allow sufficient flow of the fluid 250 to the sand screen 230. In aspects, the sand screen 230 includes integrated stand offs at its inner side to allow axial flow of the fluid along and into the inflow control device 220, as described in more detail in reference to FIGS. 3-7.

Figure 3:
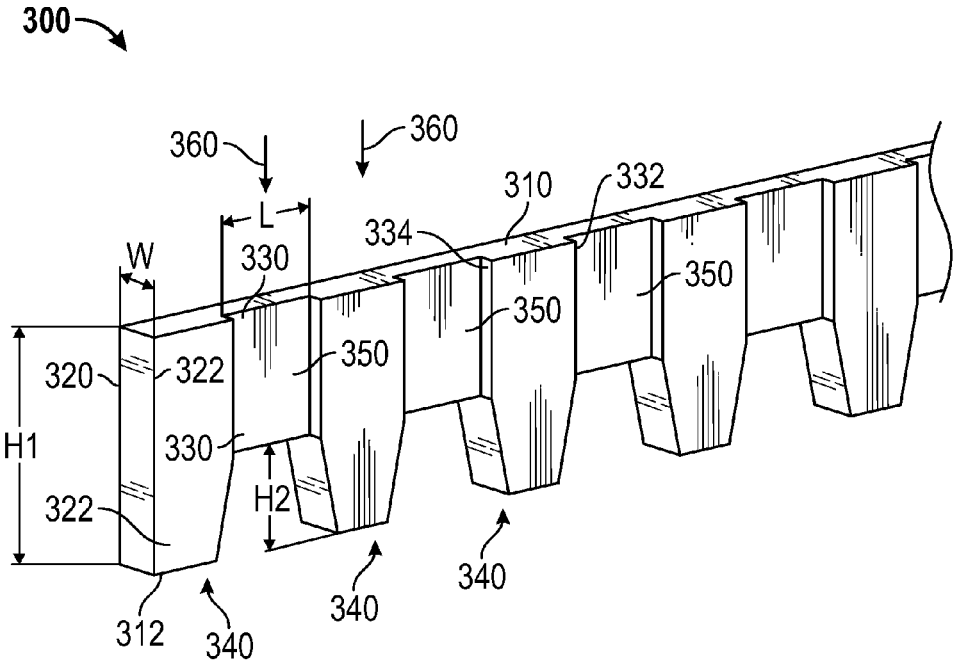
FIG. 3 shows an isometric view of a longitudinal member according to one embodiment of the disclosure that may be formed into a sand screen.

FIG. 3 shows an isometric view of a longitudinal member 300 for forming a sand screen, according to one embodiment of the disclosure. In one aspect, the longitudinal member 300 may be a continuous member, made from a material suitable for downhole use, including, but not limited to steel, steel alloy, and another metallic alloy, which can be wrapped about along a tubular or mandrel to form a sand screen. The longitudinal member 300 also is referred to herein as a "wire". In one configuration, the member 300 has a depth or height "H1" with a first axial side or an upper or top side 310, a second axial side or a lower or bottom side 312. The member 300 has width "W" that has a first side 320 and a second side 322. The particular configuration of member 300 includes serially spaced standoffs 340 of height H2 along the bottom side 312 of the member 300. Between the stand offs 340, channels 350 of width "L" and depth "D" are provided from the top side 310 extending toward the bottom side 312 to allow fluid 360 to flow radially (from outer to the inner surface) through the channels 350. The depth D defines the grain size of the solids inhibited from flowing through the channels 350, while the depth of a channel and the length L define the fluid volume that can flow through the channels 350. The member 300 may be formed by any suitable manners, including, but not limited to, extruding a material to form a continuous of height H1. The standoffs 340 and channels 350 may be formed during the extruding process, by a stamping process or cutting material from the lower side 312 to form the standoffs 340 and stamping the continuous member to form the channels 350. Any other suitable method, including, but not limited to, may be utilized to form the member 300, such as stamping and casting. In aspects, the finished member 300 is a continuous member that has integral standoffs 340 along an inner axial or longitudinal side of the member 300. In another aspect, the member 300 includes integral axial standoffs 340 and spaced apart channels 350 that allow flow of a fluid from the top side 310 toward the bottom side 312 and inhibit the flow of solids therethrough. In an alternative embodiment, the longitudinal member 300 may be a continuous member that includes flow paths or indentations, such as flow paths 350 without integral standoffs. In such a case the standoffs may be separate members placed along a length (axially) of a tubular or mandrel and the member wrapped over such standoffs to form the sand screen.

Figure 4:
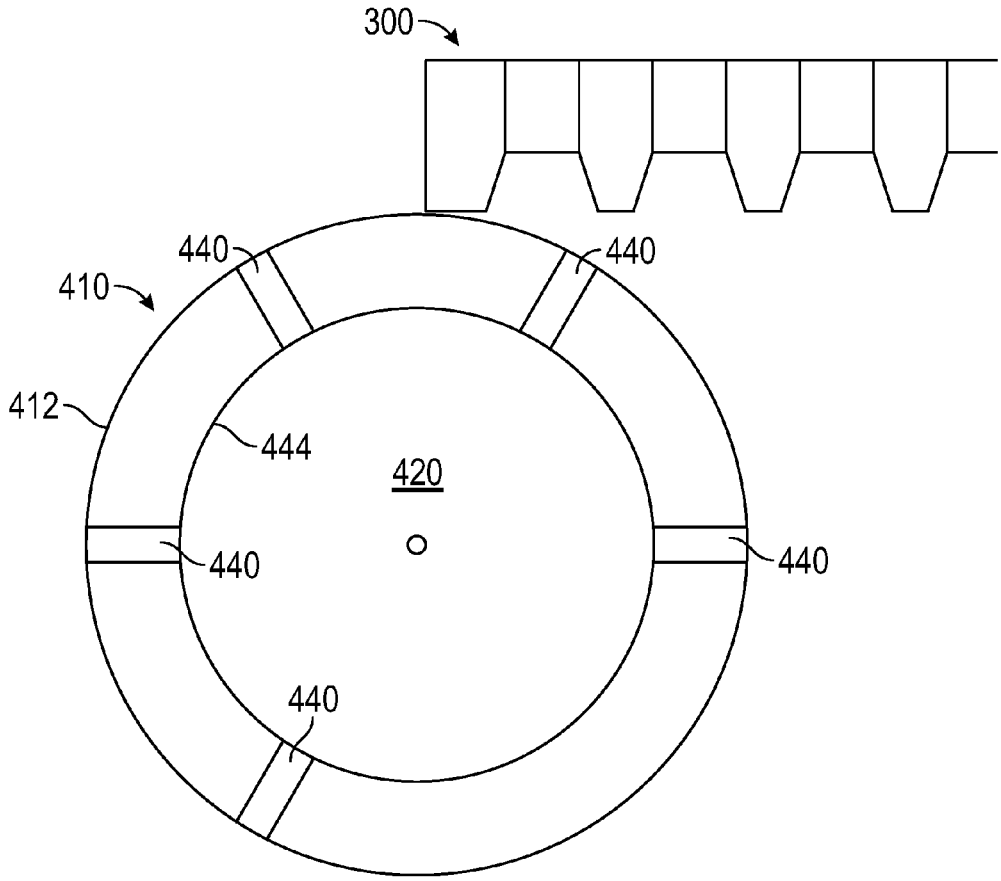
FIG. 4 shows a method of wrapping the longitudinal member of FIG. 3 onto a tubular to form a sand screen, according to one embodiment of the disclosure.

FIG. 4 shows a method of wrapping a longitudinal member, such as member 300 of FIG. 3 onto a tubular or mandrel 410 to form a sand screen, according to one embodiment of the disclosure. In one aspect, the tubular 410 may be a hollow member having central axis 420, an outer surface 412 and an inner surface 414. In another configuration, the member 410 may be a solid tubular member. To form a sand screen, the member 300 may be wrapped around the tubular 410 and some or all adjacent wraps or wrap members (also referred to "layers") may be attached to each other by any suitable method known in the art, including, but not limited to, welding and brazing. The tubular or the mandrel 410 may then be removed to provide a unitary sand screen having standoffs along an inner side to provide a first flow path and channels to provide a second flow path. Such a sand screen may then be utilized in any suitable flow control device, such as device 138 shown and described in reference to FIG. 2. In one aspect, the standoffs may be dimensioned so that they will flex when a tubular member, such as an inflow device or production tubing is inserted inside the sand screen to provide a tight fit. In another aspect, the tubular 410 may include fluid passages 440 and may not be removed from the wrapped member 300. In such a case, the finished device will be a fluid flow device that includes a base tubular having fluid passages and a sand screen on the tubular that has integral standoffs.

Figure 5:
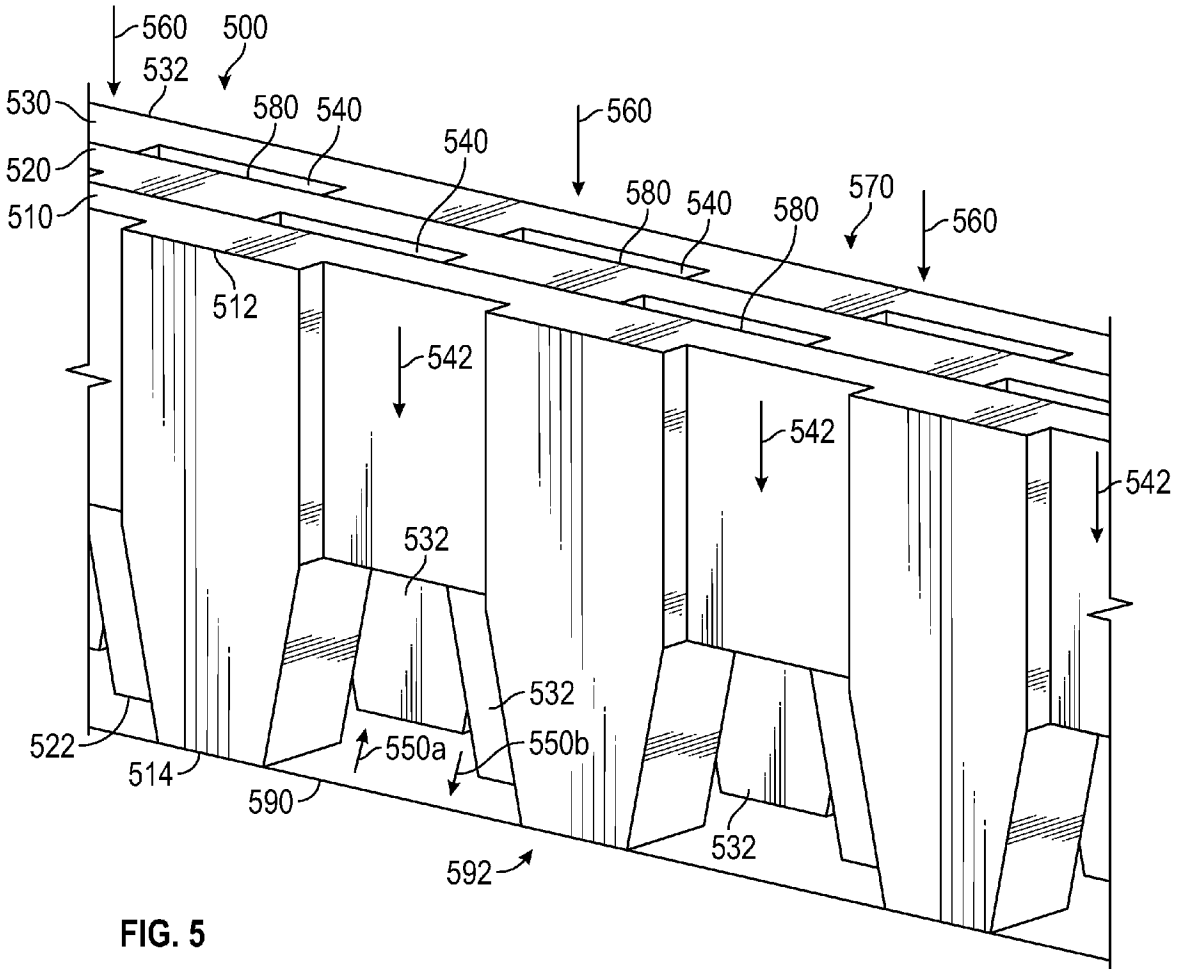
FIG. 5 shows an isometric view of a unfolded three wraps of the longitudinal member of FIG. 3.

FIG. 5 shows a partial isometric view of sand screen 500 formed using the longitudinal member 300 of FIG. 3 after the member 300 has been formed into a sand screen as described in reference to FIG. 4. FIG. 5 shows a first wrap 510, a second wrap 520 adjacent the first wrap 510 and a third wrap 540 adjacent the second wrap 520. In the sand screen section shown in FIG. 5, the adjacent wraps are connected to each other. For example, wrap 510 is connected to wrap 520 and wrap 530 is connected to wrap 520 and so on. In such a sand screen, flow channels 540 are formed between adjacent wraps as shown in FIG. 5. When sand screen 500 is installed in a device in a wellbore section, such as device 138 (FIG. 1) along the horizontal section in formation (116, FIG. 1), a fluid 560 would flow from the formation into the channels 540 and discharge above a tubular 590 over which the sand screen 500 is disposed. In the configuration shown in FIG. 5, the fluid 560 will flow axially along directions 550*a* and 550*b*. Thus, the fluid 560 will flow radially, that is from an outer surface 570 to an inner surface 572 of the sand screen, and then axially over the tubular. The gap or the width 580 of a channel, such as channels 542, defines the size of the solids inhibited from passing through the gaps 580 and thus through the sand screen 500. The dimensions and spacing of the channels 540 may be adjusted based upon the desired application. The spacing of the channels defines the amount of the fluid flow through the sand screen.

Figure 6:
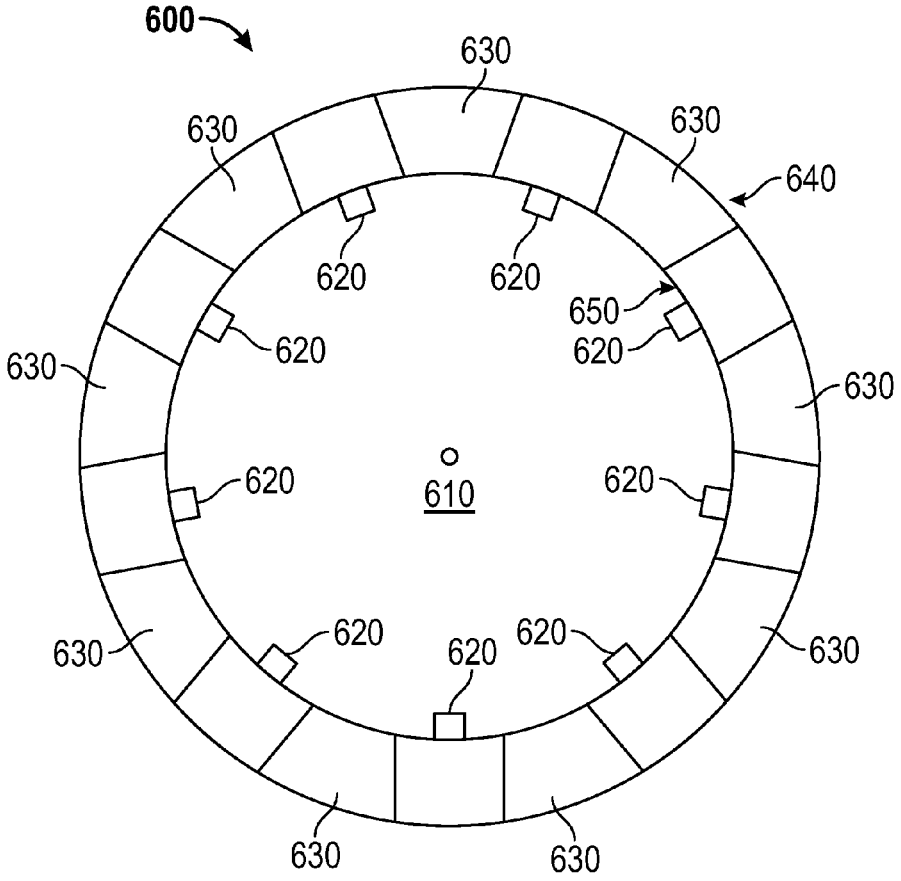
FIG. 6 shows a disc for forming a sand screen, according to one embodiment of the disclosure.

FIG. 6 shows a disc 600 having a bore 610 therethrough. The disc 600 includes standoffs 620 around the inner periphery 612 of the disc 600 and channels 630 extending from an outer surface or periphery 640 toward the inner surface or periphery 612. To form a sand screen, the discs 600 may be stacked against each other and connected to each other. In one aspect, the discs may be placed around and against each other on tubular or mandrel, such as tubular 410 shown in FIG. 4. Adjacent discs 600 may be connected to each other as they are placed against each other by any suitable mechanism. Once discs have been placed and connected to each other for a desired length, the tubular may be removed to form the sand screen that will have a unified structure substantially similar to the structure shown in FIG. 5. In another embodiment, the discs 600 may be inserted inside a longitudinal member, such as a tubular and pressed against each other to form the sand screen. In one configuration, the adjacent discs may not be attached to each other. In such a case, a device, such as an inflow control device or a production tubular may ne inserted inside the sand screen while it is still in the tubular. The tubular over the sand screen then may be removed to provide a device having a sand screen with another member inside the sand screen. In another aspect, the adjacent discs may be attached to each other by any suitable manner to form a unitary sand screen, which may then be removed from the tubular for use in another device. Although, the standoffs 340 and channels 350 (FIG. 3) and standoffs 620 and channels 630 (FIG. 6) are shown uniformly spaced, standoffs and channels may be unevenly spaced and may have different dimensions depending upon the intended application of the sand screen. Also, some discs may not include any channels.

Figure 7:
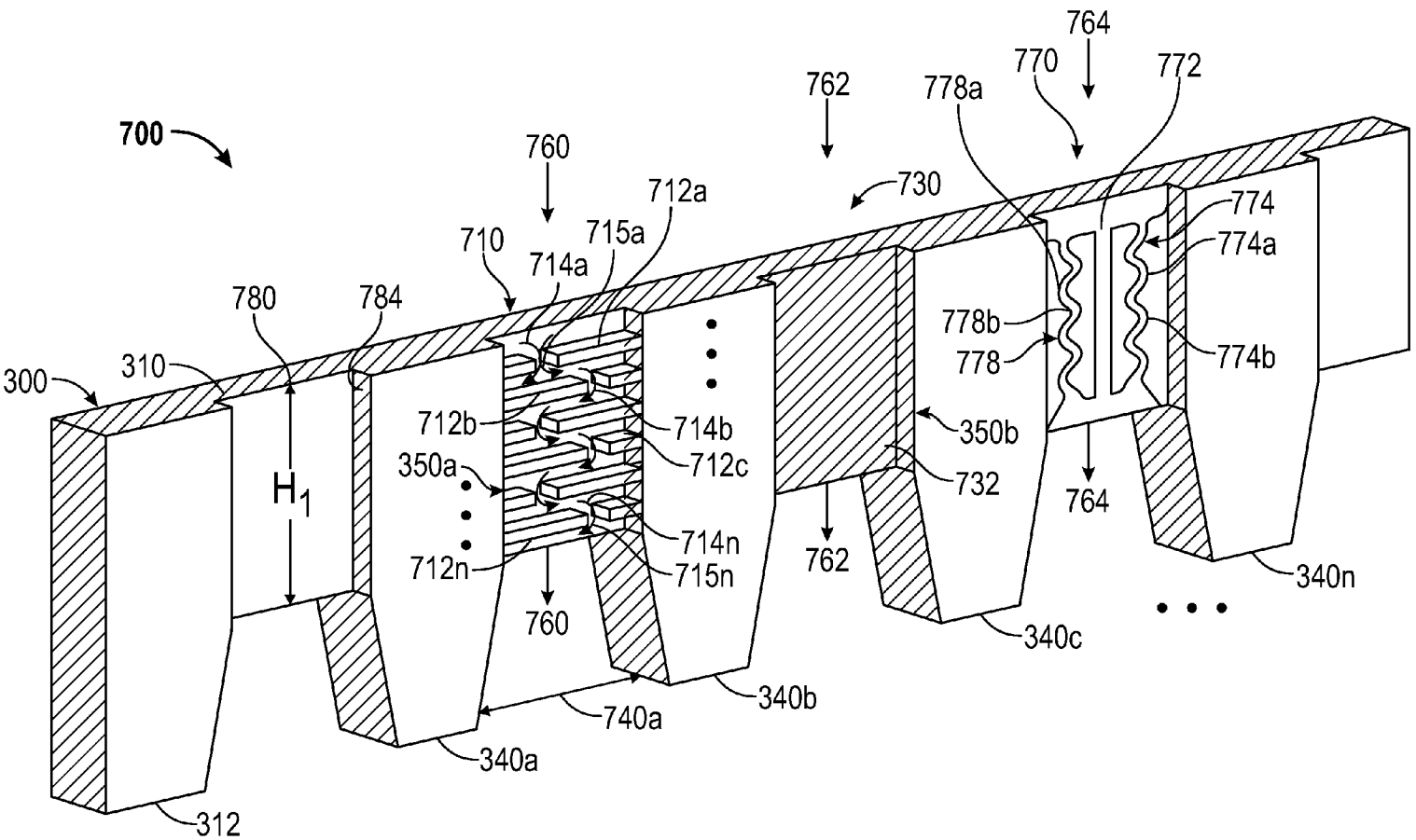
FIG. 7 shows the longitudinal member of FIG. 3 that includes exemplary inflow control devices or flow control paths that may be formed within the channels of the longitudinal member.

FIG. 7 shows a longitudinal member or wire 700 that includes the longitudinal member 300 shown in FIG. 3, having a top side 310, a bottom side 312 and standoffs 340*a*, 340*b*, 340*c*, etc. and further including different types of exemplary inflow control devices or fluid flow control paths in channels 352*a*, 352*b*, 352*c*, etc. of the member 300 to control flow of a fluid through such channels. The longitudinal member 700 is shown to include: an inflow control device or a fluid control path 710 formed in channel 352*a* according to one embodiment of the disclosure; an inflow control device or a fluid flow control path 730 in channel 352*a*, according to another embodiment of the disclosure; and an inflow control device or a flow control path 770 in channel 352*c*, according to yet another embodiment of the disclosure. The inflow control devices 710, 730 and 770 are only a few examples of flow control devices that may be placed or formed along any suitable longitudinal member or wire, including, but not limited to, a member, such as member 300, for controlling flow of a Alternatively, flow control devices, including, but not limited to devices 710, 730 and 770, may be placed in other suitable locations, including, but not limited to, discs shown in FIG. 6, to form an inflow control device, according to various embodiments of this disclosure.

Still referring to FIG. 7, in one aspect, the flow control device 710 may include one or more flow control elements or obstructions that alter direction of or provide a tortuous flow path for a fluid 760 entering the channel 710. In the particular example member 700, the flow control elements, in one aspect, may include a first horizontal obstruction 712*a*, which may be in the form of a raised member or rib, having an opening or a passage 714*a*, and another rib 712*b* spaced from the rib 712*a* and having an opening or a passage 714*b*. In other configurations, the flow control device 710 may include additional obstructions or ribs, such as ribs 712*c* through 712*n*, each having a corresponding opening or passage. In one aspect, the openings of adjacent obstructions may be offset. For example, opening 714*a* in rib 712*a* is offset from the opening 714*b* in rib 712*b*. Also, openings in ribs 714*c* through 714*n* are shown as offset. In member 700, fluid 760 entering the channel 352*a* will pass through the first opening 714*a* in rib 712*a* and change direction to the right due to the obstruction 712*b* and enter the opening 714*b* and again change direction due to the presence of rib 714*c* and so on. The fluid 760 will leave the last opening and exit the channel 352*a* in the space 740*a* between offsets 340*a* and 340*b*. Thus, in the flow control device 710, a fluid entering the channel 352*a* will flow via a tortuous flow path, as shown by arrows 715, changing flow direction at least once. The tortuous path 715, in an aspect, may create a selected pressure drop across the channel height H1, which pressure drop, in one aspect, may increase as the water content in the fluid 762 increases. In aspects, the flow control device 710 may inhibit the flow of water or gas relative to the flow of oil by creating turbulences in the spaces between ribs for the water and gas. The geometry of the obstructions 712*a* through 712*n* may be chosen to discourage or at least partially inhibit flow of a fluid based on its density, viscosity or its Reynolds number. Therefore, in aspects, the flow control device 710 may inhibit the flow of water or gas relative to the flow of oil.

Still referring to FIG. 7, channel 350*c* is shown to include a flow control device 730 that includes therein other flow control elements 732 of selected sizes, which elements, in one aspect, may be bead-like elements. The bead-like elements may be metallic elements packed or bonded in channel 352*c* to create an obstructive path for a fluid 762 passing through channel 352*c*. In aspects, the bead-like elements create a tortuous path for the fluid 762 and provide a selected pressure drop across channel 352*c*, thereby controlling flow of fluid 762 therethrough.

Still referring to FIG. 7, another flow control device 770 is shown placed in channel 350*d*. Fluid 764 enters in an open area 772 and the splits into more than one flow path. In the particular example of device 770, fluid 764 splits into three flow paths: the first flow path 774 includes one or more curved paths 774*a* and 774*b*, a second straight path 776 and a third curved path 778 that may include one or more curved paths 778*a* and 778*b* that may be same as, similar to or different from the curved paths 774*a* and 774*b* in the first flow path 774. In aspects, paths 774 and 778 create tortuous paths and may provide pressure drops that may be greater than any pressure drop provided by the straight path 776. In one aspect, the device 770 may enable flow of fluids through various paths based upon their density, viscosity or Reynolds Number. In one aspect, the straight path 776 may be more conducive to the flow of oil while paths 774 and 778 may be more conducive to the flow of water and gas. The geometry of each of the flow control devices may be chosen to provide a desired control of the flow of one or more fluids.

After placement of one or more types of flow control devices along the length of the member 700, the member 700 may be wrapped around a tubular, as described in reference to FIG. 4, to form a longitudinal inflow control device that includes a number of embedded flow control devices or paths from the top side 310 to the bottom side 312. Although, the longitudinal member 700 is shown to include standoffs, 340*a*, 340*b*, etc., such a member may not include any standoffs. In such a case, standoffs made in the form of longitudinal members of a selected height may be placed on the tubular, such as tubular 410, FIG. 4 and the member 700 without the standoffs wrapped thereon to form the inflow control device. The depth 784 of the channels defines the size of the solids prevented from entering the channels. Thus, in aspects, a device made by wrapping a longitudinal member having embedded inflow control devices and a selected channel depth provides a device that is a sand screen with an integrated inflow control device.

Alternatively, an inflow control device may be formed by embedding one or more types of flow control devices, such as devices 710, 730 and 770, in channels formed in disc members, such as members 600 shown in FIG. 6. The discs 600 having embedded flow control devices may be axially stacked and bonded together to provide a sand control device and an inflow control device as a unitary device. Members having other geometries that include flow control structures may be axially placed or stacked to form an inflow control device such a device may further include features to inhibit flow of solids of selected sizes therethrough.

Still referring to FIG. 7, any suitable mechanism may be utilized to form the longitudinal member 700 and then wrapped around a tubular or mandrel to form the inflow control device. In one aspect, the longitudinal member 300 may first be formed as described earlier and then passed through, for example, successive rollers or other devices to form the flow control device or place bead-like elements in channels. Any other suitable manufacturing method for forming the inflow control devices in a longitudinal member or discs, however, may be utilized for the purpose of this disclosure.

Figure 8:
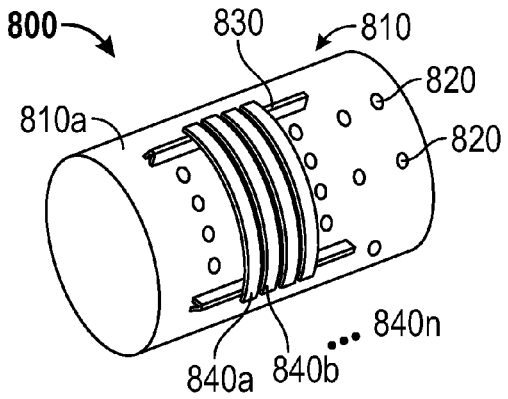
FIG. 8 shows an inflow control device formed on a tubular, wherein the wire shown in FIG. 7 is wrapped around the tubular in a helical fashion.

FIG. 8 shows an inflow control device 800 formed on a tubular 810, wherein the wire or longitudinal member, such as member 700 shown in FIG. 7, is wrapped around the tubular 810 in a helical fashion. The tubular may contain perforation or flow passages 820. The member 700 may be wrapped around the tubular 810 over spaced apart axially placed offset members, such as members 840*a*, 840*b*, etc. attached on the outer tubular surface 810*a*. Alternatively, member 700 may include integrated offsets, such as offsets 340*a*, 340*b*, etc. shown in FIG. 7.

Figure 9:
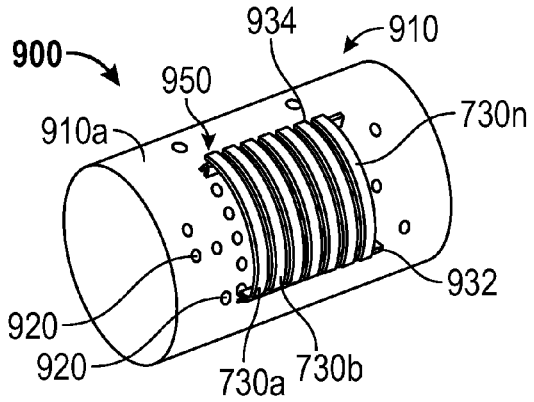
FIG. 9 shows an inflow control device formed on a tubular with circumferentially stacked members shown in FIG. 7 over a selected length or section of the tubular.

FIG. 9 shows an inflow control device 900 formed on a tubular 910, wherein segments or sections 730*a*, 730*b* through 730*n* of the longitudinal member 700 containing flow control paths shown in FIG. 7 are circumferentially oriented but placed over a section 950 of a surface 910*a* of the tubular 910. The tubular 910 is shown to include perforations or flow passages 920. The sections 730*a* through 730*n* may be placed over spaced apart circumferentially spaced apart offset members or ribs, such as ribs 932*a* and 932*b*, attached to the outer surface 910*a* of the tubular 910. Alternatively, some or all sections 730*a* through 730*n* may include integrated offsets, such as offsets 340*a*, 340*b*, etc. shown in FIG. 7.

Figure 10:
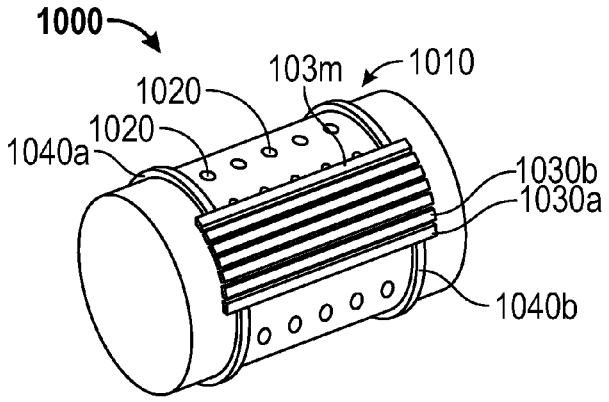
FIG. 10 shows an inflow control device formed on a tubular by axially placing sections of member shown in FIG. 7 on a surface of the tubular.

FIG. 10 shows an inflow control device 1000 formed on a surface 1010*a* of a tubular 1010, wherein sections or segments of a longitudinal member containing flow control paths, such as member 700 shown in FIG. 7, are axially oriented and circumferentially stacked over one or more discrete sections of the tubular 1010 or the entire circumference of the tubular 1010. The tubular 1010 is shown to include perforations or flow passages 1020. Segments 1030*a*, 1030*b* through 1030*m* are shown axially placed and circumferentially stacked over an outer surface 1010*a* of the tubular 1010. In one aspect, the members 1030*a* through 1030*m* may be placed over circumferentially spaced ribs, such as ribs 1040*a* and 1040*b* to provide offsets. Alternatively, the offsets may be integral to the segments 1030*a* through 1030*m*, such as offsets 340*a*, 340*b*, etc. shown in FIG. 7.

Figure 11:
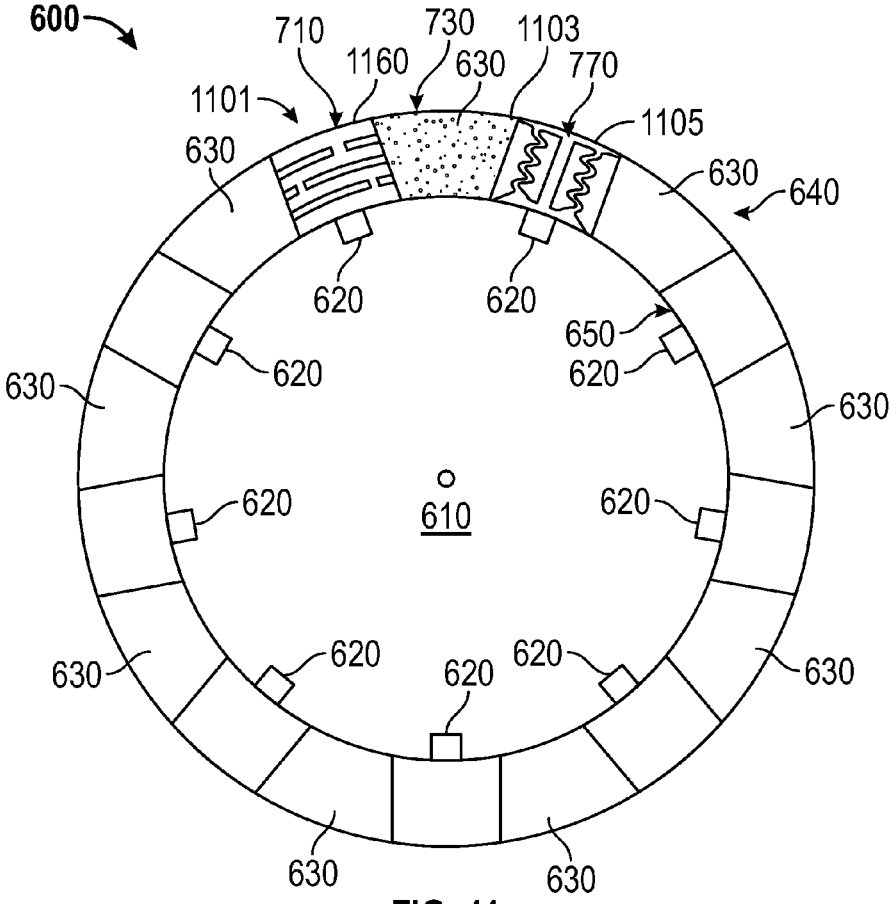
FIG. 11 shows a disc of FIG. 7 with exemplary flow control paths in the channels of the disc.

FIG. 11 shows an exemplary disc 1100 that includes the disc 600 with channels 620 of FIG. 6, wherein the channels include flow control paths or elements, such as paths and elements shown in FIG. 7. The disc 1100 is shown to contain different exemplary flow control paths or elements, which for ease of understanding are the same as shown in FIG. 7. For example, channel 1101 is shown to include the flow control paths 730 of FIG. 7, channel 1103 is shown to contain the bead-like elements 750 shown in FIG. 7, while channel 1105 is shown to include the flow control paths 770 shown in FIG. 7. However, channels 620 in the disc 1100 may include any desired flow control paths, inflow control devices or elements. In one aspect, each channel may have a top opening, such as opening 1160 of a certain size. The opening 1160 may be configured to inhibit the flow of solids above a certain size from flowing into the channels of disc 1100. Such a configuration would provide a sand control screen on the top side of such discs when axially stacked.

Figure 12:
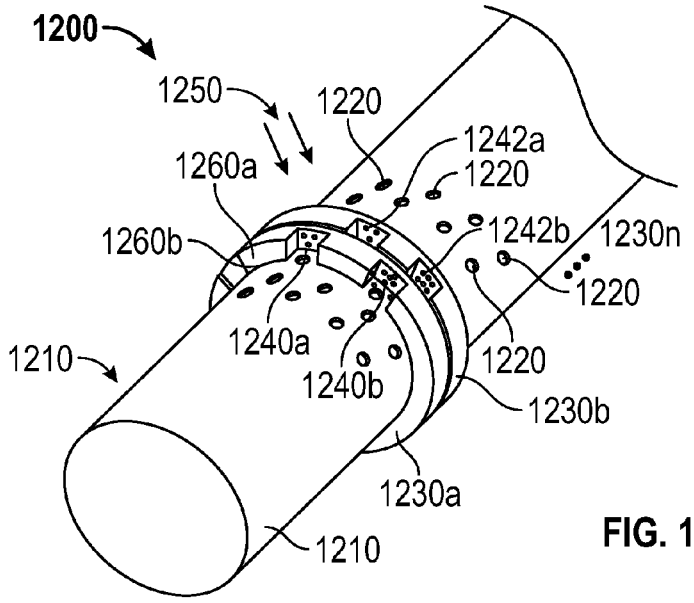
FIG. 12 show an inflow control device placed on tubular by axially stacking discs shown in FIG. 11 over a length of the tubular.

FIG. 12 show a portion of an inflow control device 1200 placed on surface 1210*a* of a tubular 1210 formed by axially stacking discs shown in FIG. 11 over a length of the tubular 1210. The tubular 1210 is shown to include perforations or flow passages 1220. The individual discs, such as discs 1230*a*, 1230*b* through 1230*p* are axially stacked against each other. The adjacent discs may be attached to each other by any suitable methods, such as bonding, welding, etc. In the example of FIG. 12, channels 1240*a* and 1240*b* in disc 1230*a* and channels 1242*a* and 1242*b* in disc 1230*b* are shown to include bead like elements to control flow of a fluid 1250 through such channels. The fluid 1250 flows from top or outside 1260*a* of the channels and exits at the bottom 1260*b* of such channels and onto the surface 1210*a* of the tubular 1210. The fluid from the surface 1210*a* passes to the inside of the tubular 1210 via the fluid passages 1220. The fluid, therefore, flows radially from outside the flow control device 1200 to the inside 1260*b* of the tubular 1210. Offsets may be provided on the inside of the discs as shown in FIG. 11 or the discs may be placed on axially placed offset members, such as ribs 932 and 934 shown in FIG. 9. In each of the embodiments of FIGS. 8-10, the fluid flows radially, i.e. from outside to inside of the flow control device. Thus, in one aspect, the disclosure provides inflow control devices for controlling flow of fluids from a formation into a wellbore radially along the length of the inflow control device. In another aspect, such flow control devices may include integrated sand screens for inhibiting flow of sold particles above a certain size from flowing into such inflow control devices.

It should be understood that FIGS. 1-12 are intended to be merely illustrative of the teachings of the principles and methods described herein and which principles and methods may applied to design, construct and/or utilizes inflow control devices. Furthermore, foregoing description is directed to particular embodiments of the present disclosure for the purpose of illustration and explanation. It will be apparent, however, to one skilled in the art that many modifications and changes to the embodiment set forth above are possible without departing from the scope of the disclosure. For example, though the embodiments herein disclose details in a production environment, it is known in the art and should be understood that the various embodiments are also contemplated to be used in an injection environment including CSS, steam assisted gravity drainage ("SAGD") and other conventional wellbore fluid flow solutions known in the art where inflow control and sand control may be desired. Still further, though the embodiments contemplate inflow control integrated within a sand screen system, it is also contemplated that where sand control is not desired, an embodiment of the invention may provide preferential discrete distributed inflow control in a robust system even where gauge spacing and the like fail to provide adequate sand control.

The invention claimed is:

1. A fluid flow device for use in a wellbore, comprising:

a tubular member having a plurality of adjacent wraps, wherein each wrap is formed by wrapping a longitudinal member about an axis, the longitudinal member having a top side and a bottom side and a plurality of spaced-apart channels extending from the top side to the bottom side, wherein at least one channel has a flow control path that changes a direction of fluid flowing through the channel in the direction of a length of the channel to provide a pressure drop that controls flow of fluid from the top side to the bottom side.

2. The fluid flow device of claim 1, wherein flow control paths are formed in the plurality of spaced apart channels.

3. The fluid flow device of claim 2, wherein a depth of each channel in the plurality of channels defines size of solid particles inhibited from entering its associated channel.

4. The fluid flow device of claim 1, wherein the flow control path includes at least one of: a tortuous fluid flow path; a combination of a tortuous fluid flow path and a substantially straight fluid flow path; a substantially straight fluid flow path; at least two spaced apart obstruction members having offset flow passages for altering direction of flow of a fluid therethrough; and a pack of elements.

5. The fluid flow device of claim 1, wherein the flow control path inhibits flow of a fluid therethrough based on one of: the density of the fluid; viscosity of the fluid; and a Reynolds Number associated with the fluid.

6. The fluid flow device of claim 1, wherein the flow control path inhibits flow of a fluid having viscosity different from viscosity of crude oil.

7. The fluid flow device of claim 1, wherein the control path is formed by one of: stamping such a flow control path along the longitudinal member; etching such flow control paths in the longitudinal member; and placing metallic elements in a channel in the longitudinal member.

8. The fluid flow device of claim 1, wherein the tubular member includes standoffs that provide a fluid flow path along the bottom side of the tubular.

9. The fluid flow device of claim 1, wherein the longitudinal member includes standoffs along the bottom side to provide a fluid flow path along the bottom side of the tubular member.

10. A fluid flow device, comprising:

a tubular member having one or more longitudinal members wrapped around the tubular member, the one or more longitudinal members having a plurality of spaced-apart channels, each channel including:

an inlet and an outlet, wherein a dimension of the inlet of the channel defines sizes of solid particles inhibited from entering the channel; and a tortuous flow path in the channel that controls flow of a fluid through the channel by changing a direction of fluid flowing through the channel in the direction of a length of the channel.

11. The fluid flow device of claim 10, wherein the tortuous path provides a selected pressure drop through the channel for the fluid.

12. A fluid flow device, comprising:

a sand screen that inhibits flow of solids greater than a certain size through the sand screen, the sandscreen including one or more longitudinal members wrapped circumferentially, the one or more longitudinal members including a plurality of channels separated by standoffs; and an inflow control device integrated into a channel of the one or more longitudinal members that controls the flow of the fluid through the channel, wherein the inflow control device changes a direction of fluid flowing through the channel in the direction of a standoff.

13. A production string, comprising:

a production tubing; and an inflow control device that includes a plurality of adjacent wraps, wherein some of the adjacent wraps include a plurality of spaced-apart channels separated by standoffs for flow therethrough, wherein a channel selected from the plurality of spaced-apart channels includes a tortuous flow control path that controls flow of a fluid from an inlet of the channel to an outlet of the channel by changing a direction of fluid flowing through the channel in the direction of a standoff.

14. The production string of claim 13, wherein a dimension of the inlet controls a size of solids that are prevented from passing through the inflow control device.

15. The production string of claim 13, wherein the tortuous fluid flow path provides a selected pressure drop across a section of the inflow control device.

16. The production string of claim 13, wherein the tortuous fluid flow path inhibits flow of one of water and gas relative to the flow of oil.

17. A method of providing a fluid flow device, comprising:

providing a longitudinal member having a plurality of channels separated by standoffs and extending from a first side to a second side of the longitudinal member, wherein at least one channel includes a flow control device that changes a direction of fluid flowing from the first side to the second side of the channel towards a direction of a standoff; and forming a tubular member using the longitudinal member to provide the fluid flow device.

18. The method of claim 17, wherein each flow control device includes a flow path that includes a tortuous path to control flow of a fluid therethrough.

19. The method of claim 17, wherein an opening in each of the channels defines sizes of solid particles that are prevented from passing through such channels.

20. A completion system, comprising:

a tubular having at least one perforation therein;

one or more flow control members having a first side and a second side mounted on the tubular, wherein the first side of each of the flow control members abuts at least a second side of the one or more flow control members to form a plurality of channels separated by stand-offs, wherein a selected channel includes a flow control path that changes a direction of fluid flowing through the channel in the direction of a standoff.

21. The completion system of claim 20, wherein the at least one or more flow control members are stackable when slidably disposed about an outer surface of the tubular.

22. The completion system of claim 20, wherein abutting of the flow control members prevents solids from passing through the completion system, thereby forming a sand screen in the completion system.

23. The completion system of claim 20, wherein the flow control path includes at least one of: a tortuous fluid flow path; a combination of a tortuous fluid flow path and a substantially straight fluid flow path; at least two spaced apart obstruction members having offset flow passages for altering direction of flow of a fluid therethrough; and a pack of elements.

24. The completion system of claim 20, wherein the flow control path inhibits flow of a fluid therethrough based on one of: density of the fluid; viscosity of the fluid; and a Reynolds Number associated with the fluid.

25. The completion system of claim 20, wherein the one or more flow control members is wrapped about an axis of the tubular in a spiral pattern along a length thereof, and wherein the first and second sides are disposed in abutting relationship along their lengths.

26. The completion system of claim 20, wherein the one or flow control members includes a plurality of longitudinal members, and wherein each longitudinal member is mounted to the tubular in abutting relationship to another longitudinal member.

27. The completion system of claim 20, wherein the plurality of longitudinal members are mounted in a generally axial relationship to the tubular and are in a side by side relationship to one another about a perforated circumference of the base pipe.

28. The completion system of claim 20, wherein the one or more flow control members are each mounted circumferentially about an axis of the tubular and are in a side-by-side relationship to one another flow control member generally along an axis of the tubular.

29. The completion system of claim 20, wherein the one or more flow control members are each mounted in a generally spiral relationship about an axis and circumference of the tubular.

* * * * *